US008393102B2

(12) United States Patent
Brown

(10) Patent No.: US 8,393,102 B2
(45) Date of Patent: Mar. 12, 2013

(54) MAGAZINE REPAIR SYSTEM FOR FIREARM

(75) Inventor: Michael J. Brown, Baltimore, MD (US)

(73) Assignee: Adcor Industries, Inc., Baltimore, MD (US)

( * ) Notice: Subject to any disclaimer, the term of this patent is extended or adjusted under 35 U.S.C. 154(b) by 0 days.

(21) Appl. No.: 13/540,083

(22) Filed: Jul. 2, 2012

(65) Prior Publication Data

US 2012/0272556 A1 Nov. 1, 2012

Related U.S. Application Data

(62) Division of application No. 12/495,996, filed on Jul. 1, 2009, now Pat. No. 8,210,090.

(60) Provisional application No. 61/133,624, filed on Jul. 1, 2008, provisional application No. 61/090,663, filed on Aug. 21, 2008.

(51) Int. Cl.
*F41A 9/61* (2006.01)

(52) U.S. Cl. ..... 42/6; 42/90; 42/106; 42/108

(58) Field of Classification Search .... 42/6, 49.01–49.1, 42/90, 106, 108
See application file for complete search history.

(56) References Cited

U.S. PATENT DOCUMENTS

| | | | |
|---|---|---|---|
| 1,379,989 | A | 5/1921 | Johnson |
| 1,402,459 | A | 1/1922 | Swebilius |
| 1,846,993 | A | 2/1932 | Destree |
| 1,878,038 | A | 9/1932 | Von Frommer |
| 2,341,767 | A | 2/1944 | Gans |
| 2,462,119 | A | 2/1949 | Moore |
| 2,685,754 | A | 8/1954 | Crittendon et al. |
| 2,752,826 | A | 7/1956 | Simpson |
| 2,775,166 | A | 12/1956 | Janson |
| 2,780,145 | A | 2/1957 | Saive |
| 2,783,685 | A | 3/1957 | Green |
| 2,882,635 | A | 4/1959 | Hill |
| 2,951,424 | A | 9/1960 | Stoner |
| 3,176,424 | A | 4/1965 | Hoge |
| 3,198,076 | A | 8/1965 | Stoner |
| 3,236,155 | A | 2/1966 | Sturtevant |
| 3,255,667 | A | 6/1966 | Walther |
| 3,300,889 | A | 1/1967 | Baker |
| 3,368,298 | A | 2/1968 | Browning |
| 3,397,473 | A | 8/1968 | Browning |
| 3,405,470 | A | 10/1968 | Wesemann |
| 3,592,101 | A | 7/1971 | Vartanian et al. |
| 3,618,457 | A | 11/1971 | Miller |
| 3,619,926 | A | 11/1971 | Alday |
| 3,675,534 | A | 7/1972 | Beretta |

(Continued)

OTHER PUBLICATIONS

Article entitled "M16 rifle" from Wikipedia, the free encyclopedia dated Jun. 2008; http://en.wikipedia.org/wiki/M-16_rifle, 20 pages.

(Continued)

*Primary Examiner* — Michelle Clement
(74) *Attorney, Agent, or Firm* — Howard & Howard Attorneys PLLC

(57) ABSTRACT

The present invention provides for a firearm including a buttstock defining a first bore extending along a longitudinal axis and a receiver coupled to the buttstock. The receiver defines a second bore extending substantially parallel to the longitudinal axis and in fluid communication with the first bore. The receiver also defines an ejection port transverse to the longitudinal axis. The firearm further includes a bolt carrier disposed in the second bore and movable relative to the receiver along the longitudinal axis between a firing position and a rearward position. The firearm also includes an expulsion device at least partially disposed in the buttstock for flowing air through the first and second bores and out the ejection port as the bolt carrier moves between the firing and rearward positions.

5 Claims, 6 Drawing Sheets

U.S. PATENT DOCUMENTS 3,686,998 A 8/1972 Seifried
3,742,636 A 7/1973 Dealy et al.
3,771,415 A 11/1973 Into et al.
3,774,498 A 11/1973 Moller et al.
3,776,095 A 12/1973 Atchisson
3,938,271 A 2/1976 Hyytinen
3,938,422 A 2/1976 Tellie
3,960,053 A 6/1976 Conley
3,969,980 A 7/1976 Grandstatter et al.
3,999,461 A 12/1976 Johnson et al.
4,020,741 A 5/1977 Junker
4,044,487 A 8/1977 Hutton et al.
4,088,057 A 5/1978 Nasypany
4,125,054 A 11/1978 Jennie
4,244,273 A 1/1981 Langendorfer, Jr. et al.
4,246,830 A 1/1981 Krieger
4,358,986 A 11/1982 Giorgio
4,389,920 A 6/1983 Dufour, Sr.
4,398,448 A 8/1983 LaFever
4,442,962 A * 4/1984 Musgrave ..... 224/255
4,505,182 A 3/1985 Sullivan
4,553,469 A 11/1985 Atchisson
4,654,993 A 4/1987 Atchisson
4,663,875 A 5/1987 Tatro
4,689,911 A 9/1987 White
4,693,170 A 9/1987 Atchisson
4,703,826 A 11/1987 Byron
4,756,228 A 7/1988 Roth
4,765,224 A 8/1988 Morris
4,766,800 A 8/1988 Miller et al.
4,819,289 A * 4/1989 Gibbs ..... 7/118
4,867,039 A 9/1989 Dobbins
4,893,547 A 1/1990 Atchisson
4,972,617 A 11/1990 Major
5,198,600 A 3/1993 E'Nama
5,343,650 A 9/1994 Swan
5,351,598 A 10/1994 Schuetz
5,417,003 A * 5/1995 Claveau ..... 42/90
5,540,008 A 7/1996 Kirnstatter
5,821,445 A 10/1998 Guhring
5,824,923 A 10/1998 Kondoh et al.
5,827,992 A 10/1998 Harris et al.
5,918,401 A 7/1999 Rowlands
5,945,626 A 8/1999 Robbins
6,019,024 A 2/2000 Robinson et al.
6,134,823 A 10/2000 Griffin
6,230,430 B1 * 5/2001 Gosselin ..... 42/90
6,311,603 B1 11/2001 Dunlap
6,418,655 B1 7/2002 Kay
6,453,594 B1 9/2002 Griffin
6,481,145 B2 11/2002 Weichert et al.
6,499,246 B1 12/2002 Zedrosser
6,564,491 B2 5/2003 Murello
6,609,321 B2 8/2003 Faifer
6,619,592 B2 9/2003 Vignaroli et al.
6,625,916 B1 9/2003 Dionne
6,634,274 B1 10/2003 Herring
6,722,255 B2 4/2004 Herring
6,726,072 B2 * 4/2004 Rugh ..... 224/269
6,732,466 B2 5/2004 Bentley
6,782,791 B2 8/2004 Moore
6,829,858 B2 12/2004 Gablowski
6,848,351 B1 2/2005 Davies
7,000,345 B1 2/2006 Kay
7,117,626 B1 * 10/2006 Alzamora et al. ..... 42/108
7,131,228 B2 11/2006 Hochstrate et al.
RE39,465 E 1/2007 Swan
7,231,861 B1 6/2007 Gauny et al.
7,418,898 B1 9/2008 Desomma
7,448,307 B1 11/2008 Dafinov
7,461,581 B2 12/2008 Leitner-Wise
7,469,624 B1 12/2008 Adams
7,478,495 B1 1/2009 Alzamora et al.
7,637,049 B1 * 12/2009 Samson et al. ..... 42/108
2003/0074822 A1 4/2003 Faifer
2005/0115134 A1 6/2005 Bond et al.
2005/0115398 A1 6/2005 Olson
2005/0262752 A1 12/2005 Robinson et al.
2006/0065112 A1 3/2006 Kuczynko et al.
2006/0156606 A1 7/2006 Robinson et al.
2006/0236582 A1 10/2006 Lewis et al.
2006/0254112 A1 11/2006 Snoderly
2007/0033851 A1 2/2007 Hochstrate et al.
2007/0199435 A1 8/2007 Hochstrate et al.
2008/0110074 A1 5/2008 Bucholtz et al.
2009/0000173 A1 1/2009 Robinson et al.
2009/0007477 A1 1/2009 Robinson et al.
2009/0031605 A1 2/2009 Robinson
2009/0031606 A1 2/2009 Robinson et al.
2009/0031607 A1 2/2009 Robinson et al.
2009/0199345 A1 * 8/2009 Morgan ..... 7/118
2011/0283588 A1 * 11/2011 Samson et al. ..... 42/108
2012/0272556 A1 * 11/2012 Brown ..... 42/6

OTHER PUBLICATIONS

Article entitled "M4 Carbine" from Wikipedia, the free encyclopedia dated Jun. 2008; http://en.wikipedia.org/wiki/M4_carbine, 7 pages.
Animation entitled "How an AR15 Works" from the website dated Jun. 2008; www.barnesengineering.com/AR15animation/index.htm, 1 page.
Article entitled "M26 Modular Accessory Shotgun System" from Wikipedia, the free encyclopdia dated Jun. 2008; http://en.wikipedia.org/wiki/M26_Modular_Accessory_Shotgun_System, 2 pages.
Article entitled "The USA's M4 Carbine Controversy" dated Feb. 2, 2009; www.defenseindustrydaily.com/the-usas-m4-carbine-controversy-03289/, 15 pages.
Article entitled "M4 Carbine Review" dated May 2, 2007; http://home.comcast.net/ shooter2_indy/m4.html, 2 pages.
Article entitled "Critics Turn Crosshairs on Military's Main Rifle" dated Apr. 20, 2008 from the website "USA Today"; www.usatoday.com/news/miliary/2008-04-20-gunwars_N.htm, 5 pages.
Parts Schematic entitled "Schematic for Bushmaster M4A3 Carbine" from the website "Bushmaster" dated Jun. 2008; www.bushmaster.com/electronic-documents/operation-manual/opmanual.pdf, 1 page.
Article entitled "M26 Modular Accessory Shotgun Systems Photos and Videos" from the website "The Firearm Blog" dated Nov. 2, 2007; www.thefirearmblog.com/blog/2007/11/02/m26-modular-accessory-shotgun-system-photos-and-video/, 6 pages.
Catalog item LMT: Standard MRP (rifle) version from the website "Lewis Machine Tool Company" dated Jun. 2008; www.lewismachine.net/product.php?p=56&cid=8 &session=85945e8b595ef2d461b8980961cf870a, 2 pages.

* cited by examiner

MAGAZINE REPAIR SYSTEM FOR FIREARM

CROSS REFERENCE TO RELATED APPLICATIONS

The subject application is a divisional of U.S. patent application Ser. No. 12/495,996, filed on Jul. 1, 2009, which claims priority to and the benefits of U.S. Provisional Patent Application Ser. No. 61/133,624, filed on Jul. 1, 2008 and U.S. Provisional Patent Application Ser. No. 61/090,663, filed on Aug. 21, 2008, the disclosures of each are hereby incorporated by reference in their entirety.

BACKGROUND OF THE INVENTION

1. Field of the Invention

The subject invention relates to firearms and more specifically to mechanisms that minimize fouling of firing components.

2. Description of the Prior Art

Firearms typically include a receiver that houses several working components of the firearm, including firing components, with a barrel extending from the receiver. There are various classes of firearms that operate in different manners. One class of firearm utilizes a bolt carrier disposed in the receiver that is movable between a firing position, from which a live round of ammunition can be fired, and a retracted position, from which a spent casing is ejected. The movement of the bolt carrier and ejection of the casing can be accomplished with a direct gas impingement or indirect gas impingement system. Examples of gas impingement type firearms include the M16, the M4®, such as the M4® carbine, and the AR-15®, such as the AR-15® Platform.

Firearms having the direct gas impingement system typically include an ejection port defined by the receiver. Direct gas impingement systems route exhaust gases back through the firearm to move the bolt carrier toward the retracted position. In particular, after firing the firearm, the direct gas impingement system routes exhaust gases, including any associated debris, from the barrel, back through a return tube to the bolt carrier, and out the ejection port of the receiver.

Firearms having the indirect gas impingement system do not route the exhaust gases back to the bolt carrier in an effort to reduce fouling caused by the exhaust gases that may occur with direct gas impingement type firearms. Instead, the exhaust gases are used to move a device, such as a piston, that engages the bolt carrier to move the bolt carrier toward the rearward position. However, this type of firearm is still susceptible to fouling of the firing components due to debris entering through the ejection port.

Some firearms include an ejection port door for covering the ejection port to prevent debris from entering the receiver and fouling the firing components. The ejection port door automatically opens in response to firing the firearm and/or charging the firearm, i.e. loading a live round into a chamber of the barrel. However, when the ejection port door opens during firing of the firearm, debris is able to enter the ejection port and foul the firing components, which potentially causes the firearm to jam or fail.

Therefore, there remains a need to develop a mechanism that minimizes or prevents debris from entering the ejection port and fouling the firing components.

SUMMARY OF THE INVENTION AND ADVANTAGES

The present invention provides for a firearm including a buttstock defining a first bore extending along a longitudinal axis and a receiver coupled to the buttstock. The receiver defines a second bore extending substantially parallel to the longitudinal axis and in fluid communication with the first bore. The receiver also defines an ejection port transverse to the longitudinal axis. The firearm further includes a bolt carrier disposed in the second bore and movable relative to the receiver along the longitudinal axis between a firing position and a rearward position. The firearm also includes an expulsion device at least partially disposed in the buttstock for flowing air through the first and second bores and out the ejection port as the bolt carrier moves between the firing and rearward positions.

The present invention further provides for a method of operating the firearm having the buttstock defining the first bore and the receiver coupled to the buttstock. The receiver defines an ejection port and a second bore in fluid communication with the first bore. The firearm further includes the bolt carrier disposed in the second bore and movable between the firing position and the rearward position. A piston is disposed in the first bore and defines a hole with a first valve attached to the piston adjacent the hole. The method includes the steps of firing the firearm and simultaneously moving the piston and the bolt carrier toward the rearward position after firing the firearm. The method further includes the steps of opening the first valve during movement of the piston and the bolt carrier toward the rearward position. The method also includes the step of directing air through the hole of the piston and the second bore of the receiver during movement of the piston and the bolt carrier toward the rearward position. The method also includes the step of expelling the air from the hole and the second bore out the ejection port of the receiver.

Additionally, the present invention provides for a magazine repair system for the firearm with the system including a plurality of rounds. The system further includes the receiver defining a void with a barrel attached to the receiver and defining a chamber for receiving the rounds. The magazine repair system includes the buttstock adapted to be coupled to the receiver and having an outer surface. A magazine for housing the rounds is adapted to selectively engage the void of the receiver. The magazine includes a top portion having a pair of tabs extending outwardly from the top portion for feeding the rounds into the chamber of the barrel. The magazine repair system further includes a guide member attached to the outer surface of the buttstock and configured to reform the tabs when the tabs are deformed relative to the top portion for properly positioning the tabs to permit proper feeding of the rounds into the chamber of the barrel.

Accordingly, the present invention defines a mechanism, in the form of an expulsion device, that expels air out of an ejection port during firing of a firearm for preventing debris from entering the ejection port and fouling the firing components, i.e. the action. In addition, the present invention provides for a magazine repair system for reforming a pair of tabs of a magazine when the tabs are deformed to properly position the tabs to permit proper feeding of a plurality of rounds into a chamber of a barrel.

BRIEF DESCRIPTION OF THE DRAWINGS

Other advantages of the present invention will be readily appreciated, as the same becomes better understood by reference to the following detailed description when considered in connection with the accompanying drawings.

DETAILED DESCRIPTION OF THE INVENTION

Figure 1:
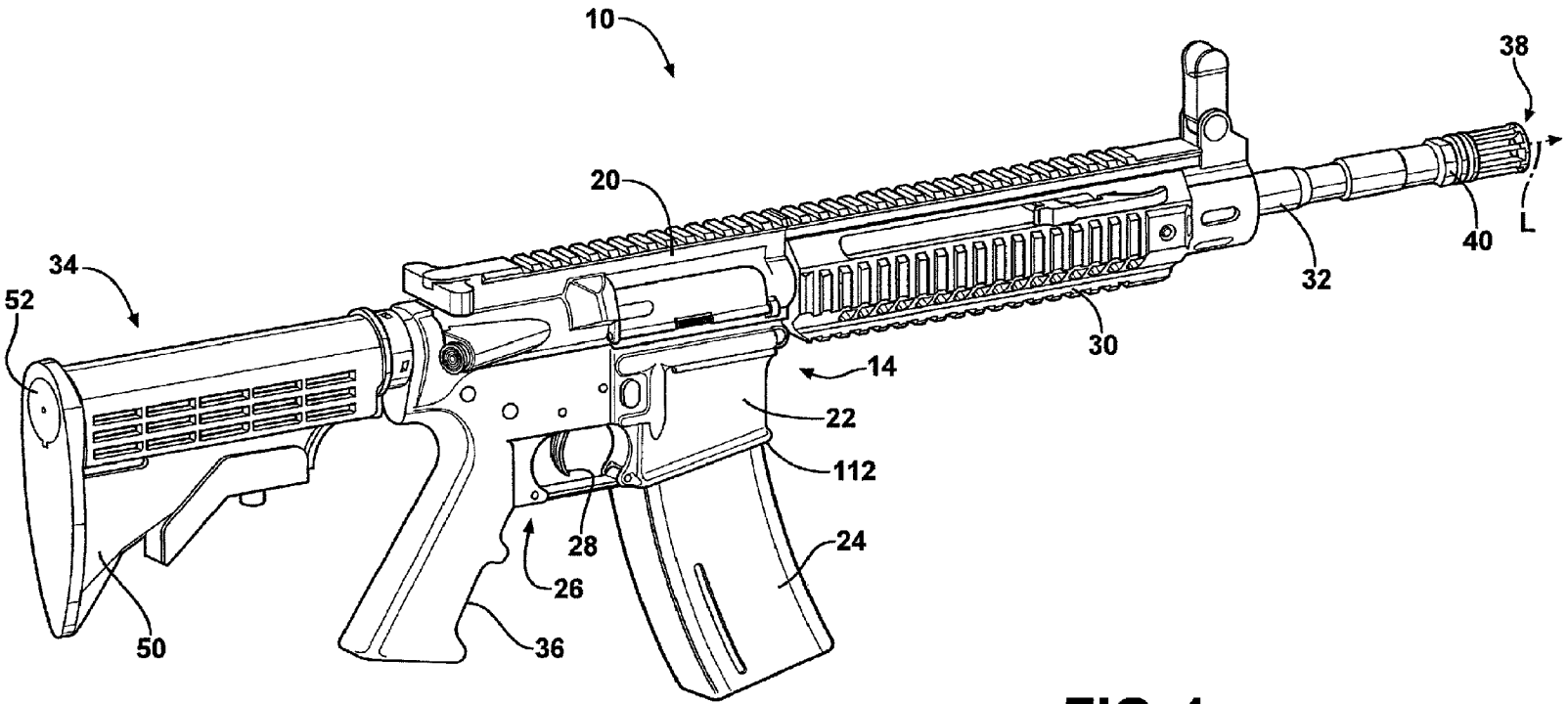
FIG. 1 is a perspective view of a firearm.

Referring to the Figures, wherein like numerals indicate like or corresponding parts throughout the several views, a firearm 10 is generally shown in FIG. 1. The firearm 10 receives and fires a live round (not shown) of ammunition (hereinafter "live round"), also referred to as a cartridge, which includes a casing, a bullet, and other components to propel the bullet as known to those skilled in the art.

The firearm 10 can be of a certain class of firearms 10 that utilize a direct gas impingement system or an indirect gas impingement system to eject a spent casing after firing the firearm 10. Examples of such types of firearms 10 include the M16, the M4®, such as the M4® carbine, and the AR-15®, such as the AR-15® Platform. However, it should be appreciated that the firearm 10 can be of any type without departing from the nature of the present invention. The firearm 10 described herein is designed to permit easy retro-fitting of the components to a variety of currently and/or previously manufactured firearm designs including direct gas impingement systems and indirect gas impingement systems. The indirect gas impingement system utilizes a piston assembly (not shown) for moving a bolt carrier 12 (see FIG. 2), as further disclosed and claimed in U.S. patent application Ser. No. 12/496,000 filed concurrently with the present application, which is incorporated herein by reference.

Figures 2, 2A:
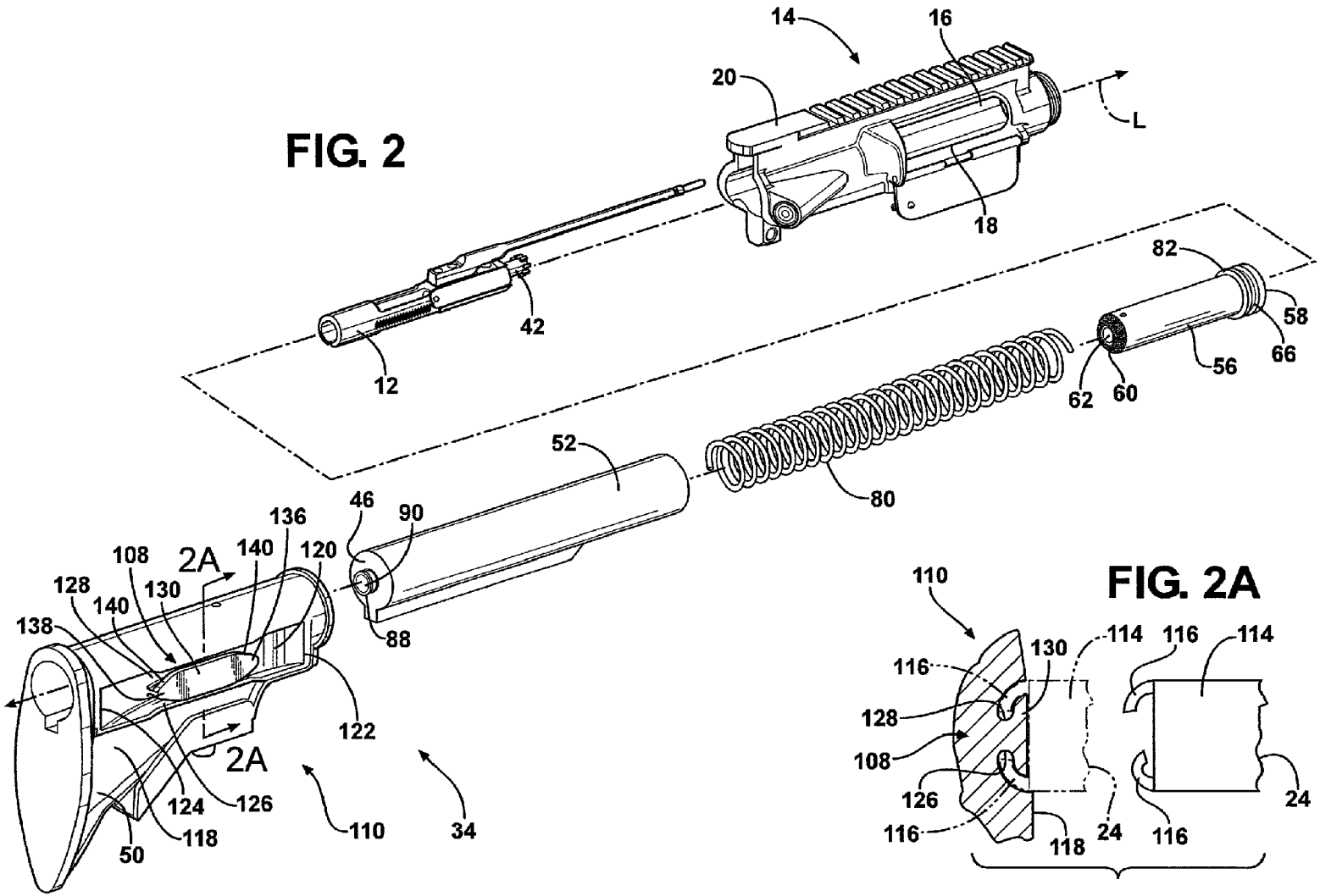
FIG. 2 is a partially exploded perspective view of the firearm having an expulsion device and a magazine repair system.
FIG. 2A is a fragmented end view of a magazine having one tab deformed and a fragmented cross-sectional view of the magazine repair system taken along lines 2A-2A of FIG. 2 with a fragmented phantom magazine having the deformed tab reformed.
Figure 3:
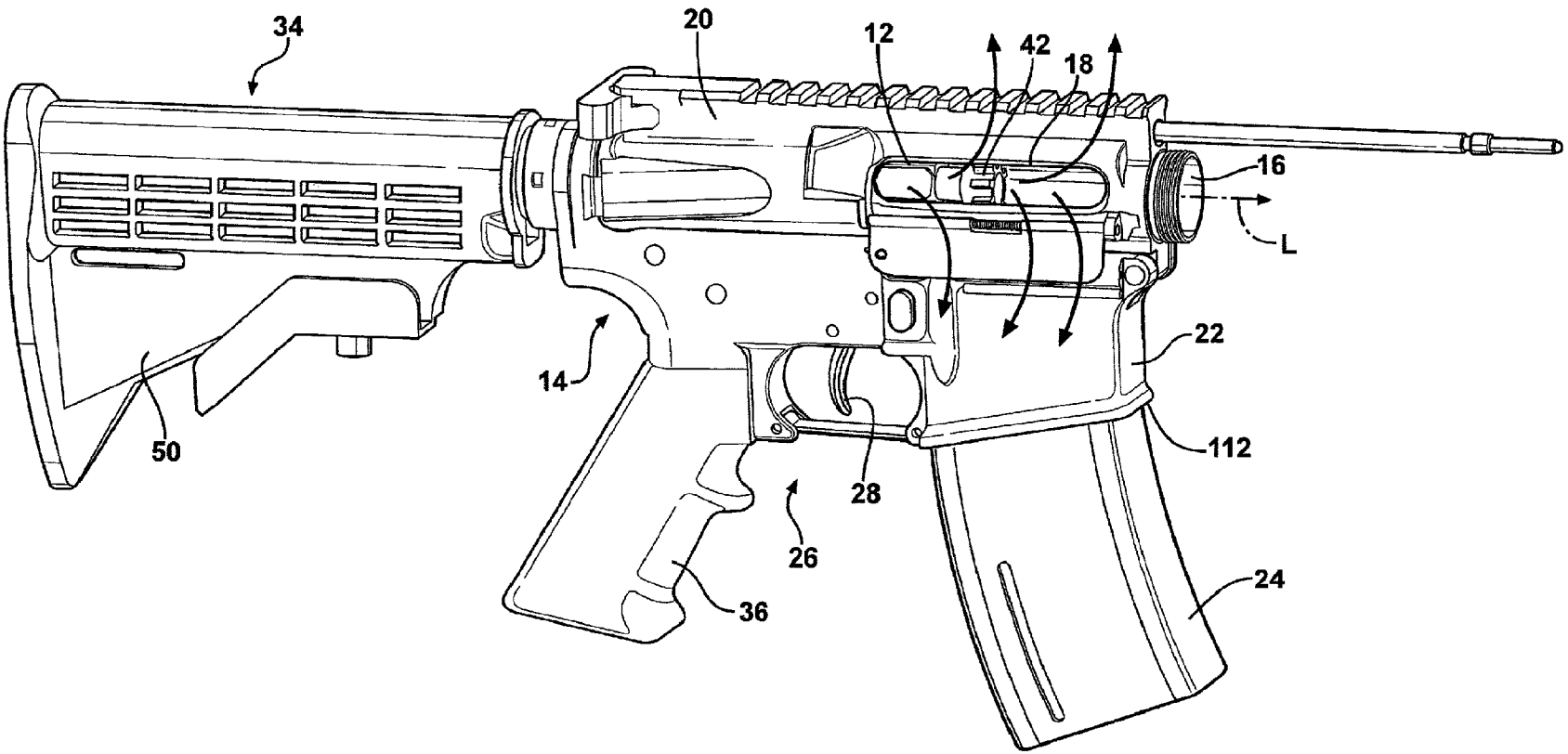
FIG. 3 is a perspective view of the firearm with certain components removed and the bolt carrier moving toward the rearward position and expelling air out of an ejection port.

Also referring to FIGS. 2 and 3, the firearm 10 includes a receiver 14 defining a bore 16 extending along a longitudinal axis L and houses several working components of the firearm 10, such as the firing components, i.e. the action. The bore 16 of the receiver 14 will be referred to as a second bore 16 throughout this description. As used herein, the phrase "along the longitudinal axis" includes components and/or movements aligning with the longitudinal axis L and/or spaced from and substantially parallel to the longitudinal axis L. The receiver 14 defines an ejection port 18 transverse to the longitudinal axis L. As known in the art, the receiver 14 is often divided into an upper receiver portion 20 and a lower receiver portion 22 attached to the upper receiver portion 20. The upper receiver portion 20 defines the second bore 16 and the ejection port 18.

A magazine 24, also referred to as a clip, is detachably mounted to the lower receiver portion 22 and can be loaded with a plurality of live rounds, as discussed further below. The firearm 10 further includes a trigger assembly 26 supported by the receiver 14. The trigger assembly 26 includes a trigger 28 and a hammer (not shown). The trigger 28 is pulled to move the hammer, which, as discussed further below, ultimately results in the firing of the firearm 10.

The firearm 10 includes a hand guard 30 that extends from the receiver 14 circumferentially about a barrel 32 such that a user can hold the hand guard 30 of the firearm 10. Details of the hand guard 30 are further disclosed and claimed in U.S. patent application Ser. No. 12/496,000 filed concurrently with the present application, which is incorporated herein by reference. A buttstock 34 extends rearwardly from the receiver 14 for supporting the firearm 10 against a shoulder of the user. A hand grip 36 extends downwardly along the lower receiver portion 22 for gripping by the user.

The barrel 32 is coupled to the receiver 14 and defines a barrel bore 38 extending along the longitudinal axis L. The details of how the barrel 32 is coupled to the receiver 14 is further disclosed and claimed in U.S. patent application Ser. No. 12/496,000 filed concurrently with the present application, which is incorporated herein by reference. The barrel 32 includes a breech (not shown) adjacent the receiver 14 and a muzzle 40 spaced from the breech along the longitudinal axis L with the breech defining a chamber (not shown) extending along the longitudinal axis L for receiving one of the live rounds. The live rounds are individually loaded into the chamber from the magazine 24. The chamber aligns with the barrel bore 38 such that the bullet moves out of the chamber and the barrel bore 38 when firing the firearm 10. Details of the components of the barrel 32 are further disclosed and claimed in U.S. patent application Ser. No. 12/496,000 filed concurrently with the present application, which is incorporated herein by reference.

The bolt carrier 12 is disposed in the second bore 16 of the receiver 14. The bolt carrier 12 is movable relative to the receiver 14 along the longitudinal axis L between a firing position and a rearward position. Specifically, a bolt 42 and a firing pin (not shown) are carried by the bolt carrier 12. The bolt carrier 12 typically has features for automatically releasing another live round from the magazine 24 into the chamber as the bolt carrier 12 moves toward the firing position. As the bolt carrier 12 moves from the rearward position toward the firing position, the bolt carrier 12 catches or pushes another live round into the chamber of the barrel 32. In the firing position, the bolt 42 locks to the breech of the barrel 32 to hold the live round in the chamber. The firing components can include the bolt carrier 12, the bolt 42, the firing pin, the trigger 28, the hammer and other components as known to those skilled in the art.

When the bolt carrier 12 is in the firing position, the trigger 28 can be pulled to release the hammer, which strikes the firing pin. When the hammer strikes the firing pin, the firing pin strikes the live round to fire the live round, which causes the bullet to move through and out of the barrel bore 38. After firing the live round, the bolt carrier 12 moves by gas impingement toward the rearward position and the casing, which is now empty, is expelled from the receiver 14 through the ejection port 18. The bolt carrier 12 automatically moves toward the firing position thereby automatically loading another live round from the magazine 24 into the chamber.

Although the firearm 10 shown in the Figures is of the semi-automatic type or the automatic type, it is appreciated that the firearm 10 can also be a single-shot firearm 10 without departing from the nature of the present invention. A semi-automatic firearm 10 is one that fires a single live round when the trigger 28 is pulled and thereafter automatically loads another live round. An automatic firearm 10 is one that individually fires multiple live rounds with a single pull of the trigger 28 and continues to load and fire live rounds until the trigger 28 is released. A single-shot firearm 10 requires manual loading of each live round and fires a single live round when the trigger 28 is pulled.

Figure 4:
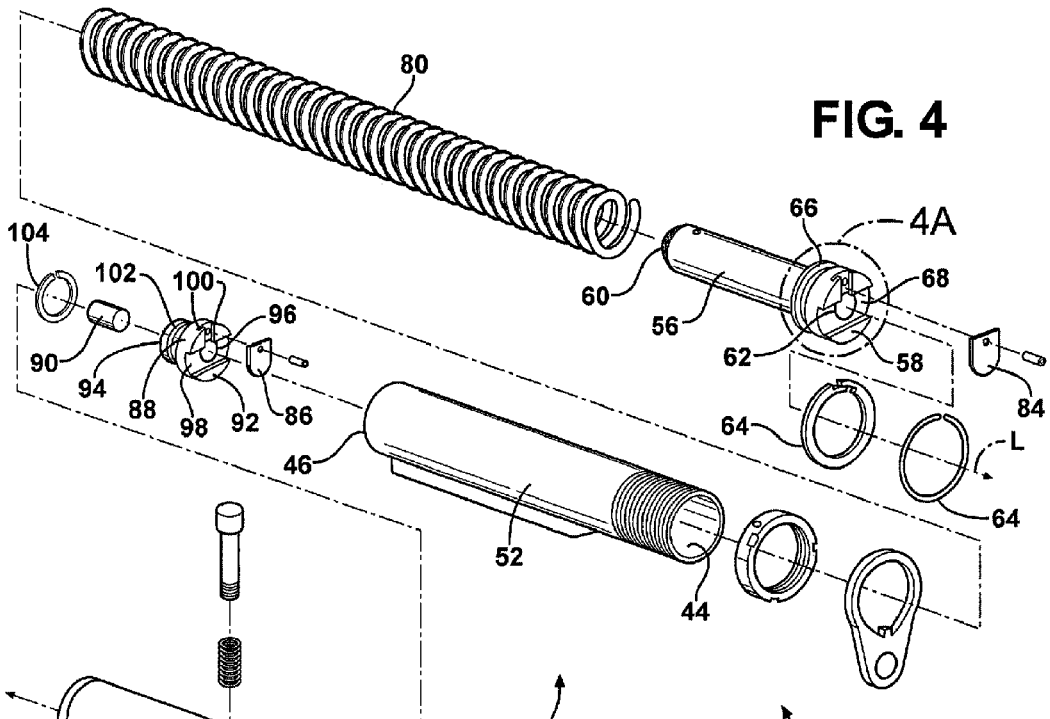
FIG. 4 is a partially exploded perspective view of the expulsion device.

Also referring to FIG. 4, the firearm 10 includes the buttstock 34 defining a first bore 44 extending along the longitudinal axis L and the receiver 14 coupled to the buttstock 34. The buttstock 34 includes a distal end 46 spaced from the receiver 14 along the longitudinal axis L and defines an aperture 48 open to the first bore 44 (see FIGS. 5-7). The buttstock 34 includes a stock 50 and a container 52 disposed within the stock 50. More specifically, the container 52 defines the distal end 46, the aperture 48, and the first bore 44.

The receiver 14 defines the second bore 16 extending substantially parallel to the longitudinal axis L and in fluid communication with the first bore 44. The second bore 16 is also in fluid communication with the ejection port 18. The bolt carrier 12 is disposed in the second bore 16 and movable relative to the receiver 14 along the longitudinal axis L between the firing position and the rearward position. The first and second bores 44, 16 align with each other relative to the longitudinal axis L for allowing the bolt carrier 12 to partially move into the first bore 44 during movement toward and away from the rearward position.

The firearm 10 also includes an expulsion device 54 at least partially disposed in the buttstock 34 for directing or flowing air through the first and second bores 44, 16 and out the ejection port 18 as the bolt carrier 12 moves between the firing and rearward positions, as shown in FIG. 3. Preferably, the expulsion device 54 is entirely disposed in the buttstock 34. Even more preferably, the container 52 houses the entire expulsion device 54.

Turning to FIGS. 2, 4, 4A and 5, the expulsion device 54 includes a piston 56 disposed in one of the first and second bores 44, 16. The piston 56 includes a front end 58 and a back end 60 spaced from the front end 58 along the longitudinal axis L with the front end 58 abutting the bolt carrier 12 such that the piston 56 is movable with the bolt carrier 12 between the firing and rearward positions. The piston 56 is disposed in the first bore 44 and defines a hole 62 extending along the longitudinal axis L between the front and back ends 58, 60 with the hole 62 in fluid communication with the first and second bores 44, 16 for directing or expelling air out the ejection port 18. The hole 62 will be referred to as a first hole 62 throughout this description. The back end 60 of the piston 56 is coated with a synthetic material. It is to be appreciated that the back end 60 may be coated with any other suitable material(s).

Figure 4A:
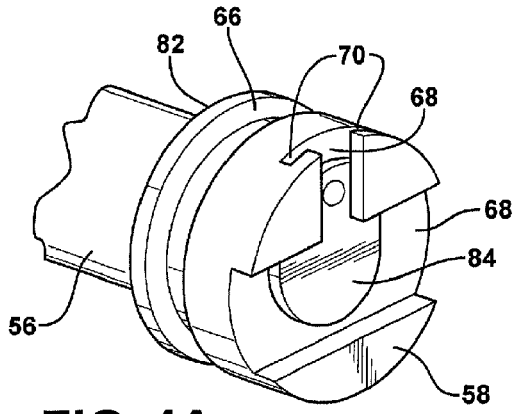
FIG. 4A a fragmented enlarged perspective view of a first valve coupled to a piston of FIG. 4.

The piston 56 further includes at least one seal 64 or gasket disposed between the piston 56 and the buttstock 34 for preventing air from leaking therebetween. It is to be appreciated that a plurality of seals 64 may be utilized. As best shown in FIG. 4A, the piston 56 defines a first groove 66 adjacent the front end 58 with the first groove 66 extending about a circumference of the piston 56. The seal 64 is disposed in the first groove 66 such that the seal 64 moves with the piston 56 during movement between the firing and rearward positions. The front end 58 of the piston 56 defines a first cutout 68 extending toward the back end 60 and defines a first slit 70 extending transverse to the longitudinal axis L, which will be discussed further below.

Figure 5:
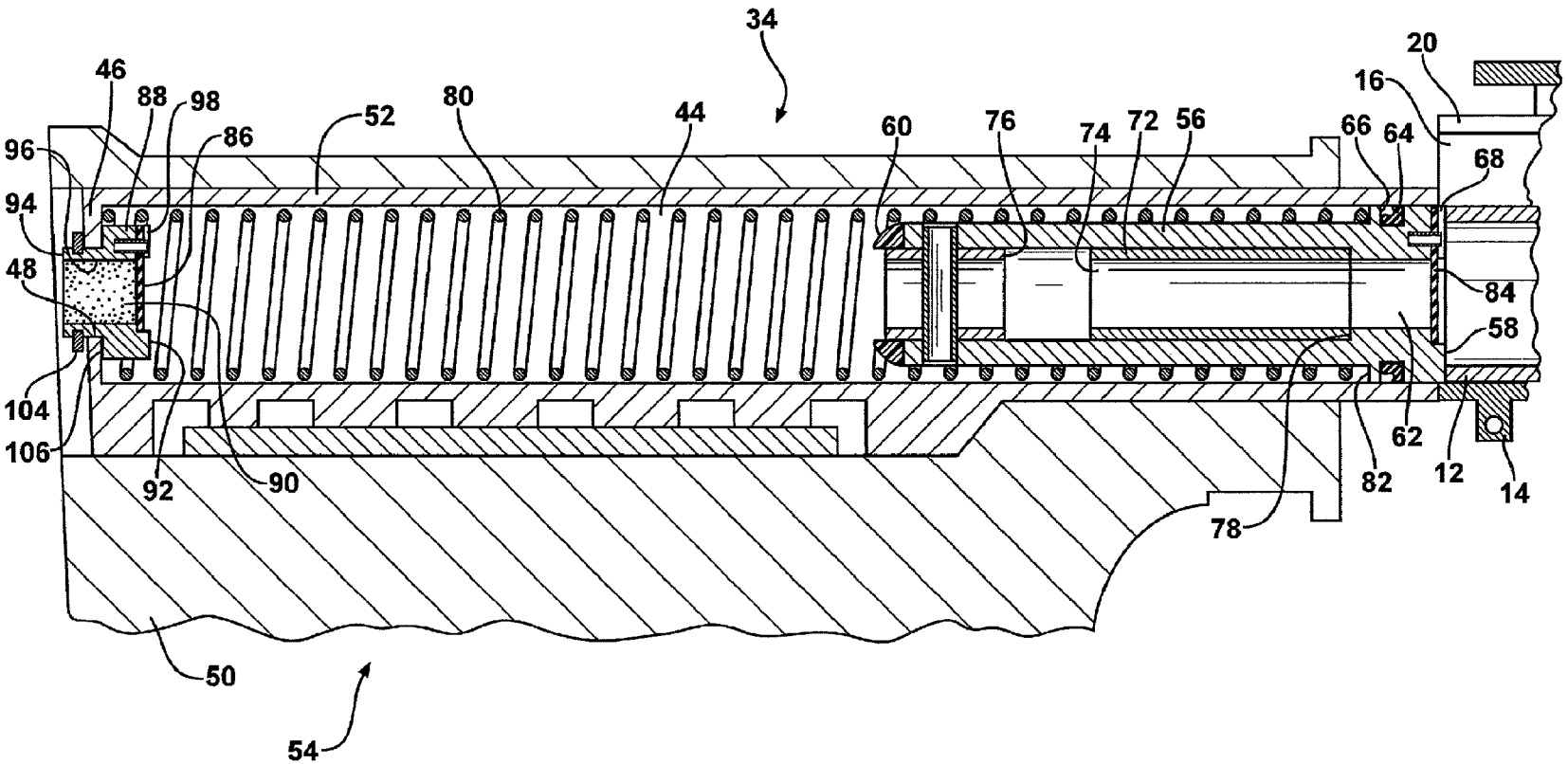
FIG. 5 is a fragmented cross-sectional view of a piston and a bolt carrier in a firing position.

Referring to FIG. 5, the expulsion device includes a weight 72 movably disposed within the first hole 62 of the piston 56. The weight 72 defines an orifice 74 extending along the longitudinal axis L and open to the first hole 62 for directing or routing air therethrough. A stop 76 is pinned within the first hole 62 of the piston 56 proximal to the back end 60 for preventing the weight 72 from moving out of the piston 56 during movement between the firing and rearward positions. An abutment 78 is spaced from the stop 76 and disposed within the first hole 62 proximal to the front end 58.

Figure 6:
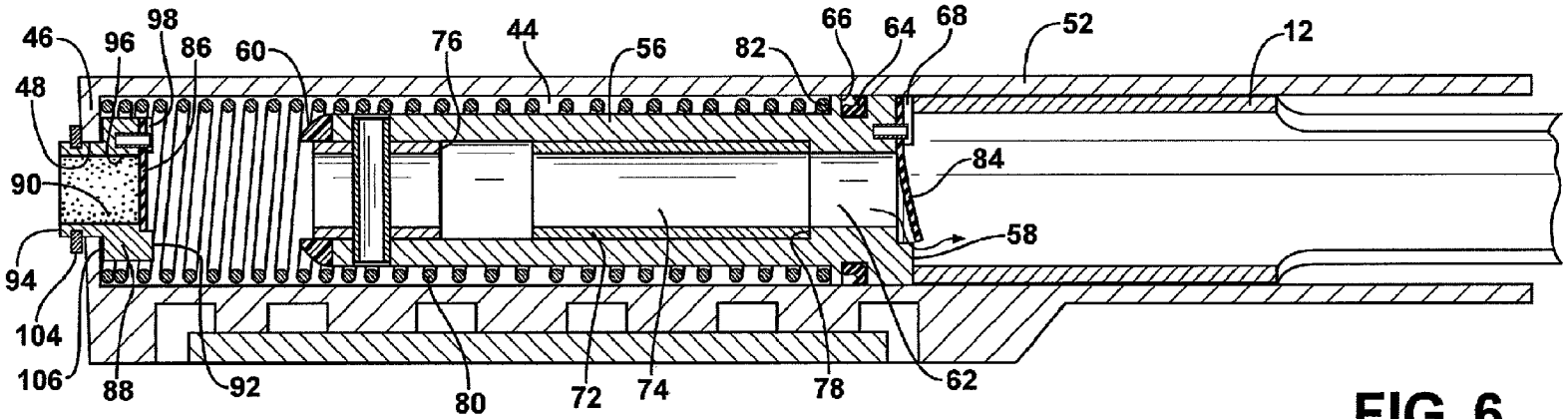
FIG. 6 is a fragmented cross-sectional view of the piston and the bolt carrier moving toward a rearward position.
Figure 7:
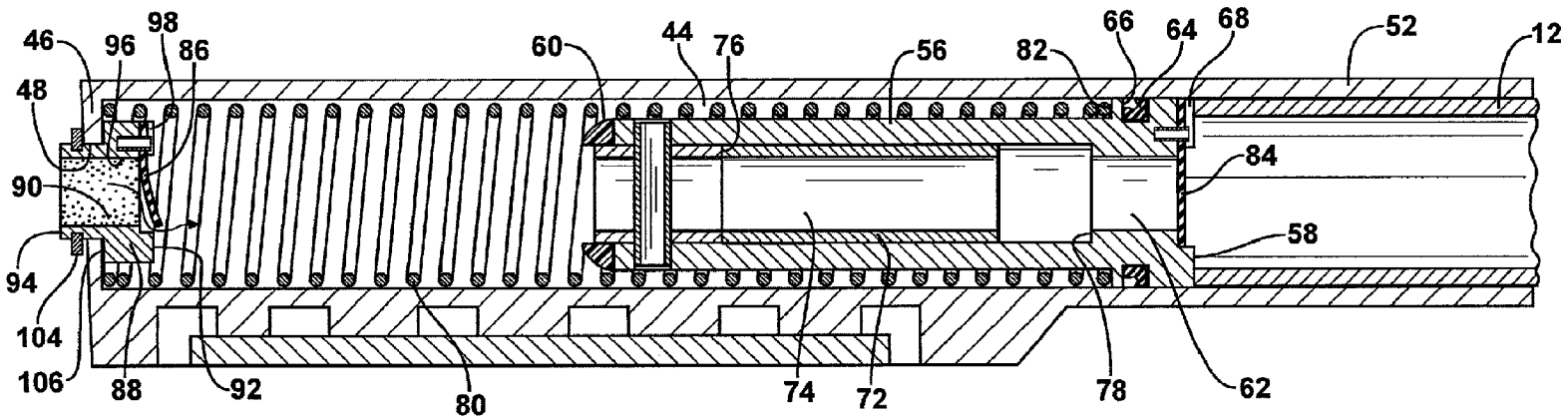
FIG. 7 is a fragmented cross-sectional view of the piston and the bolt carrier moving toward the firing position.

Referring to FIG. 6, the weight 72 engages the abutment 78 when the piston 56 moves toward the rearward position. Referring to FIG. 7, the weight 72 engages the stop 76 when the piston 56 moves toward the firing position. In addition, the weight 72 engages the abutment 78 when the bolt carrier 12 returns to the firing position and engages the barrel 32. More specifically, when the bolt 42 initially engages the barrel 32, a reaction force causes the bolt 42 to start to move backwards; however, the weight 72 moves forward and engages the abutment 78 which prevents the bolt 42 and the bolt carrier 12 from moving backwards. In other words, when the bolt 42 initially engages the barrel 32, the weight 72 moves to the abutment 78 and acts as a buffer. Thus, the weight 72 abuts the abutment 78 prior to firing the firearm 10.

Referring back to FIGS. 4, 4A and 5, the expulsion device 54 also includes a biasing member 80 abutting the buttstock 34 and the piston 56 for absorbing energy and continuously biasing the piston 56 into engagement with the bolt carrier 12 and into the firing position. The biasing member 80 may be further defined as a spring or any other suitable biasing member 80 for biasing the piston 56 and absorbing energy. More specifically, the piston 56 includes a shoulder 82 between the front and back ends 58, 60 with the biasing member 80 abutting the shoulder 82 and the distal end 46 of the buttstock 34.

The expulsion device 54 further includes a first valve 84 coupled to one of the buttstock 34 and the piston 56 for selectively expelling or flowing air out of the ejection port 18. More specifically, the first valve 84 is coupled to the piston 56 for selectively expelling or flowing air though the second bore 16 and out the ejection port 18. When assembling the piston 56, the first valve 84 slides through the first slit 70 and is pinned to the piston 56 through the first cutout 68. Referring back to FIG. 4A, a first portion of the first valve 84 is in the first cutout 68 and a remaining portion of the first valve 84 is in the first slit 70 such that the first valve 84 is able to move back and forth to open and close the first hole 62.

Turning to FIGS. 6 and 7, the first valve 84 is movable between a first position preventing air from flowing out the ejection port 18 and a second position allowing air to flow out the ejection port 18. More specifically, the first valve 84 is coupled to the front end 58 of the piston 56 adjacent the first hole 62 and movable between the first position with the first valve 84 disposed over the first hole 62 preventing air from flowing out the ejection port 18 and the second position with the first valve 84 spaced from the first hole 62 allowing air to flow out the ejection port 18.

The expulsion device 54 also includes a second valve 86 coupled to the buttstock 34 for selectively flowing air into the first bore 44. The second valve 86 is movable between a third position preventing air from flowing into the first bore 44 and a fourth position allowing air to flow into the first bore 44. More specifically, the second valve 86 is attached to the distal end 46 adjacent the aperture 48 within the first bore 44 and movable between the third position with the second valve 86 disposed over the aperture 48 preventing air from flowing into the first bore 44 and the fourth position with the second valve 86 spaced from the aperture 48 allowing air to flow into the first bore 44. Referring to FIG. 6, the first valve 84 is in the second position and the second valve 86 is in the third position as the bolt carrier 12 moves toward the rearward position. Referring to FIG. 7, the first valve 84 is in the first position and the second valve 86 is in the fourth position as the bolt carrier 12 moves toward the firing position.

Each of the first and second valves 84, 86 can be further defined as a check valve such as a leaf valve, a reed valve, a ball-spring valve, a sheet metal spring or any other suitable valve that allows one way flow. The first valve 84 can be pinned to the piston 56 by a roll pin or any other suitable fastener. The second valve 86 can be similarly pinned to the distal end 46 by a roll pin or any other suitable fastener.

The expulsion device 54 includes a plug 88 attached to the distal end 46 within the aperture 48 and a filter 90 disposed in the plug 88. The filter 90 filters particles as air moves into the first bore 44 while the bolt carrier 12 moves toward the firing position. In other words, the filter 90 catches particles to allow clean air to move into the first bore 44 for preventing fouling of the components of the firearm 10.

The plug 88 includes a front side 92 and a back side 94 spaced from each other along the longitudinal axis L. The plug 88 defines a second hole 96 extending along the longitudinal axis L between the front and back sides 92, 94 with the filter 90 disposed in the second hole 96. The second hole 96 is in fluid communication with the first bore 44 for flowing air into the first bore 44 when the piston 56 and the bolt carrier 12 move toward the firing position. More specifically, the second valve 86 is pinned to the plug 88 for selectively flowing air into the first bore 44. In other words, when the second valve 86 is in the third position, the second valve 86 is disposed over the second hole 96 preventing air from flowing into the first bore 44 and when the second valve 86 is in the fourth position, the second valve 86 is spaced from the second hole 96 allowing air to flow into the first bore 44.

Referring back to FIG. 4, the plug 88 further defines a second cutout 98 extending toward the back side 94 and defines a second slit 100 extending transverse to the longitudinal axis L. The second valve 86 is disposed in the second cutout 98 and the second slit 100. More specifically, when assembling the plug 88, the second valve 86 slides through the second slit 100 and is pinned to the plug 88 through the second cutout 98. A first portion of the second valve 86 is in the second cutout 98 and a remaining portion of the second valve 86 is in the second slit 100 such that the second valve 86 is able to move back and forth to open and close the second hole 96. Even though the second valve 86 is not shown assembled to the plug 88, FIG. 4A is illustrative of how the second valve 86 is attached to the plug 88.

The plug 88 also defines a second groove 102 adjacent the back side 94 with the second groove 102 extending about a circumference of the plug 88. A fastener 104, such as a snap ring or any other suitable fastener, is disposed in the second groove 102 for attaching the plug 88 to the buttstock 34 and more specifically, for attaching the plug 88 to the aperture 48 of the container 52. The plug 88 includes a lip 106 between the front and back sides 92, 94 with the fastener 104 abutting one side of the distal end 46 and the lip 106 abutting another side of the distal end 46 for attaching the plug 88 to the buttstock 34. The stock 50 extends slightly beyond the container 52 due to the back side 94 of the plug 88 being attached to the distal end 46 for allowing air to flow through the second hole 96 when the firearm 10 is abutting against the shoulder of the user and for preventing damage to the back side 94 of the plug 88.

A method of operating the firearm 10 having the buttstock 34 defining the first bore 44 and the receiver 14 coupled to the buttstock 34 is now discussed in greater detail. The receiver 14 defines the ejection port 18 and the second bore 16 in fluid communication with the first bore 44. The bolt carrier 12 is disposed in the second bore 16 and movable between the firing and rearward positions. The piston 56 is disposed in the first bore 44 and defines the first hole 62 with the first valve 84 attached to the piston 56 adjacent the first hole 62.

FIG. 5 illustrates the firearm and the air expulsion device in a rest state. The method includes the steps of firing the firearm 10 and simultaneously moving the piston 56 and the bolt carrier 12 toward the rearward position after firing the firearm 10 as shown in FIG. 6. The first valve 84 is opened during movement of the piston 56 and the bolt carrier 12 toward the rearward position. More specifically, the step of opening the first valve 84 is further defined as spacing the first valve 84 away from the first hole 62 during movement of the piston 56 and the bolt carrier 12 toward the rearward position.

The method also includes the step of directing air through the first hole 62 of the piston 56 and the second bore 16 of the receiver 14 during movement of the piston 56 and the bolt carrier 12 toward the rearward position. More specifically, the weight 72 is disposed in the first hole 62 of the piston 56 and defines the orifice 74 open to the first hole 62 and further including the step of directing air through the first hole 62 and the orifice 74 during movement of the piston 56 and the bolt carrier 12 toward the rearward position, again, see FIG. 6. The method also includes the step of expelling the air from the first hole 62 and the second bore 16 out the ejection port 18 of the receiver 14 as shown in FIG. 3. In other words, as the piston 56 moves toward the rearward position, the volume between the piston 56 and the distal end 46 decreases and pressure builds therein. Once a predetermined pressure is reached, the first valve 84 opens and the air is directed or routed out of the first bore 44 and expelled through the first hole 62, the orifice 74, and the second bore 16 and out the ejection port 18.

The second valve 86 is attached to the buttstock 34 with the method including the step of simultaneously opening the second valve 86 and closing the first valve 84 during movement of the piston 56 and the bolt carrier 12 toward the firing position as shown in FIG. 7. More specifically, the buttstock 34 defines the aperture 48 open to the first bore 44 with the second valve 86 adjacent the aperture 48 with the step of simultaneously opening the second valve 86 and closing the first valve 84 is further defined as spacing the second valve 86 from the aperture 48 and engaging the first valve 84 against the first hole 62 during movement toward the firing position. The step of opening the first valve 84 during movement of the piston 56 and the bolt carrier 12 toward the rearward position occurs before the step of simultaneously opening the second valve 86 and closing the first valve 84 during movement of the piston 56 and the bolt carrier 12 toward the firing position. In other words, as the piston 56 moves back toward the firing position, a vacuum is created within the first bore 44 due to the air being previously expelled out of the first bore 44. When a predetermined pressure of the vacuum is reached, the second valve 86 opens and fresh air flows into the first bore 44.

The method further includes the step of flowing air through the aperture 48 and into the first bore 44 during movement of the piston 56 and the bolt carrier 12 toward the firing position. In other words, fresh or clean air flows into the first bore 44 during movement of the piston 56 and the bolt carrier 12 toward the firing position. The step of flowing air through the aperture 48 and into the first bore 44 occurs after the step of expelling the air from the first hole 62 and the receiver 14 out the ejection port 18. In addition, the method includes the step of continuously biasing the piston 56 and the bolt carrier 12 toward the firing position.

Referring back to FIGS. 2 and 2A, a magazine repair system 110 is disclosed. This system 110 is an alternative feature that may be provided on the stock 50. For illustrative purposes, a more traditional stock, with the magazine repair system being removed, is shown in the remaining figures. The buttstock 34, the magazine 24 and a guide member 108 define the magazine repair system 110 for the firearm 10. The magazine 24 is adapted to selectively engage a void 112 of the receiver 14 and houses the rounds. The magazine 24 including a top portion 114 having a pair of tabs 116 extending outwardly from the top portion 114 for feeding the rounds into the chamber of the barrel 32.

The buttstock 34 includes an outer surface 118. More specifically, the stock 50 defines the outer surface 118. The outer surface 118 defines a recess 120 with the guide member 108 attached to the buttstock 34 within the recess 120. Specifically, the guide member 108 is flush or recessed from the outer surface 118 for preventing unwanted catching of objects by the guide member 108. The recess 120 includes a first side 122 and a second side 124 spaced from each other substantially parallel to the longitudinal axis L, which will be discussed further below.

The guide member 108 is attached to the outer surface 118 of the buttstock 34 and configured to reform the tabs 116 of the magazine 24 when the tabs 116 are deformed relative to the top portion 114 for properly positioning the tabs 116 to permit proper feeding of the rounds into the chamber of the barrel 32. The guide member 108 can be attached to either side of the buttstock 34 or a plurality of guide members 108 can be utilized with one guide member 108 attached to each side of the buttstock 34. Alternatively, the guide member 108 could be mounted to other parts of the firearm 10.

The guide member 108 defines a first channel 126 and a second channel 128 spaced from the first channel 126 to define a central body 130 between the first and second channels 126, 128. The first and second channels 126, 128 selectively receive the tabs 116.

As shown in FIG. 2A, the first and second channels 126, 128 each have an arcuate inward configuration corresponding to the proper position of the tabs 116 relative to the top portion 114 with the tabs 116 being reformed to a correspondingly arcuate inward configuration as the tabs 116 move through the first and second channels 126, 128. The magazine 24, as shown in solid lines in FIG. 2A, has a deformed tab 116 that requires reforming. The tabs 116 are inserted into the first and second channels 126, 128 with the deformed tab 116 being reformed as shown in phantom lines in FIG. 2A.

The central body 130 includes a first end 136 and a second end 138 spaced from each other with the first end 136 having a tapered portion 140 for guiding the tabs 116 into the first and second channels 126, 128. Alternatively, the second end 138 can have the tapered portion 140 or both the first and second ends 136, 138 can have the tapered portion 140 (as shown in FIG. 2) for guiding the tabs 116 into the first and second channels 126, 128. The first end 136 of the central body 130 is spaced from the first side 122 of the recess 120 and the second end 138 is spaced from the second side 124 such that the tabs 116 are inserted and removed from the guide member 108 from either end. Alternatively, one of the ends 136, 138 of the central body 130 can abut the sides 122, 124 of the recess 120 such that the tabs 116 are inserted and removed from the guide member 108 in only one direction Obviously, many modifications and variations of the present invention are possible in light of the above teachings. The foregoing invention has been described in accordance with the relevant legal standards; thus, the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. A magazine repair system for a firearm with the system including a plurality of rounds and a receiver defining a void with a barrel attached to the receiver and defining a chamber for receiving the rounds; said system comprising:

a buttstock adapted to be coupled to the receiver and having an outer surface;

a magazine for housing the rounds and adapted to selectively engage the void of the receiver with said magazine including a top portion having a pair of tabs extending outwardly from said top portion for feeding the rounds into the chamber of the barrel; and a guide member attached to said outer surface of said buttstock and configured to reform said tabs when said tabs are deformed relative to said top portion for properly positioning said tabs to permit proper feeding of the rounds into the chamber of the barrel.

2. A system as set forth in claim 1 wherein said guide member defines a first channel and a second channel spaced from said first channel to define a central body between said first and second channels with said first and second channels selectively receiving said tabs.

3. A system as set forth in claim 2 wherein said central body includes a first end and a second end spaced from each other with said first end having a tapered portion for guiding said tabs into said first and second channels.

4. A system as set forth in claim 2 wherein said first and second channels each have an arcuate inward configuration corresponding to said proper position of said tabs relative to said top portion with said tabs being reformed to a correspondingly arcuate inward configuration as said tabs move through said first and second channels.

5. A system as set forth in claim 1 wherein said outer surface defines a recess with said guide member attached to said buttstock within said recess.

* * * * *